US005400854A

United States Patent [19]

Iio et al.

[11] Patent Number: 5,400,854

[45] Date of Patent: Mar. 28, 1995

[54] HEAT EXCHANGER

[75] Inventors: Masatoshi Iio, Yokohama; Mituo Kimura, Kawasaki, both of Japan

[73] Assignees: Nissan Motor Co., Ltd., Yokohama; Tokyo Radiator Mfg Co., Ltd., Kanagawa, both of Japan

[21] Appl. No.: 205,869

[22] Filed: Mar. 3, 1994

[30] Foreign Application Priority Data

Mar. 4, 1993 [JP] Japan ..... 5-044169

[51] Int. Cl.[6] ..... F28D 7/10

[52] U.S. Cl. ..... 165/157; 165/166

[58] Field of Search ..... 165/166, 167, 157

[56] References Cited

U.S. PATENT DOCUMENTS

| | | | |
|---|---|---|---|
| 1,730,139 | 10/1929 | Harrison | 165/167 |
| 2,868,514 | 1/1959 | Hodson et al. | 165/167 X |
| 3,129,756 | 4/1964 | Ramén | 165/157 |
| 5,301,747 | 4/1994 | Daschmann et al. | 165/166 |

FOREIGN PATENT DOCUMENTS

| | | | |
|---|---|---|---|
| 2110168 | 6/1972 | France | 165/166 |
| 63-49189 | 4/1988 | Japan . | |
| 393568 | 12/1973 | U.S.S.R. | 165/166 |

*Primary Examiner*—Allen J. Flanigan

*Attorney, Agent, or Firm*—Lowe, Price, LeBlanc & Becker

[57] ABSTRACT

A heat exchanger of a brazed-plate-fine type and a counter-flow type consists of a plurality of tube elements which define first-fluid flowing spaces while inner fins are disposed in the spaces, respectively. The tube elements are alternately laminated with a plurality of outer fins, and the laminated elements and fins are surrounded by a housing for constituting a second-fluid flowing space. A first-fluid inlet port and a first-fluid outlet ports are formed so as to outwardly project from a lateral side of the outer fin. The housing is formed to have curved portions conforming with projecting outer peripheries of the inlet and outlet ports. Accordingly, the heat transmission efficiency of the heat exchanger is improved.

12 Claims, 12 Drawing Sheets

HEAT EXCHANGER

BACKGROUND OF THE INVENTION

1. Field of the Invention

The present invention relates to improvements in a brazed-plate-fine type heat exchanger, and more particularly to a counter-flow type heat exchanger.

2. Description of the Prior Art

Hitherto a heat exchanger as shown in FIG. 16 of the drawing of the present application has been proposed and disclosed, for example, in Japanese Utility Model Provisional Publication No. 63-49189. This conventional heat exchanger is provided with a plurality of tube elements 52 defining a first passage 61 for low-temperature fluid A and a housing 56 defining a second passage 62 for high-temperature fluid B by surrounding the tube elements 52. The low-temperature fluid A flows through the tube elements 52 from inlet ports 54 to outlet ports 55 in the direction indicated by arrows of FIG. 16. The high-temperature fluid B flows through the second passage 62 such that the flowing direction of the fluid B is perpendicular to that of the fluid A to implement the heat transmission therebetween. That is, the heat exchanger is so called a cross-flow type. Accordingly, such a conventional brazed-plate-fine type and cross-flow type heat exchanger has a restriction in the improvement of the heat transmission coefficient. Furthermore, due to a clearance 51 between the tube elements 52 and a side plate 58 in this conventional heat exchanger, a substantial amount of the high-temperature fluid B flows through the clearance 51 and therefore the heat transmission between the high-temperature fluid B and the low-temperature fluid A is not effectively implemented.

SUMMARY OF THE INVENTION

It is an object of the present invention to provide a counter flow type heat exchanger which realizes a high heat transmission efficiency.

A heat exchanger for first and second fluids according to the present invention comprises a plurality of tube elements which defines first fluid flowing spaces, respectively. A plurality of inner fins are disposed in the first-fluid flowing space of the tube elements, respectively. A first-fluid inlet port is connected to the tube elements so as to direct the first fluid into the first-fluid flowing space. The first-fluid inlet port is located so as to outwardly project from a lateral side of the inner fins. A first-fluid outlet port is connected to the tube elements so as to discharge the first fluid from the first-fluid flowing space. The first-fluid inlet port is located to outwardly project from the lateral side of the inner fin. A plurality of outer fins are alternately laminated with the tube elements. A housing surrounds the tube elements and defines a second-fluid flowing space therebetween. The housing has a second-fluid inlet port and an second-fluid outlet port. The housing is formed so as to be curved along a peripheral wall of the tube element which defines the first-fluid inlet and outlet ports.

Thus, this arrangement improves the heat transmission efficiency between the first and second fluids and reduces a size of the heat exchanger.

DETAILED DESCRIPTION OF THE INVENTION

Figure 1:
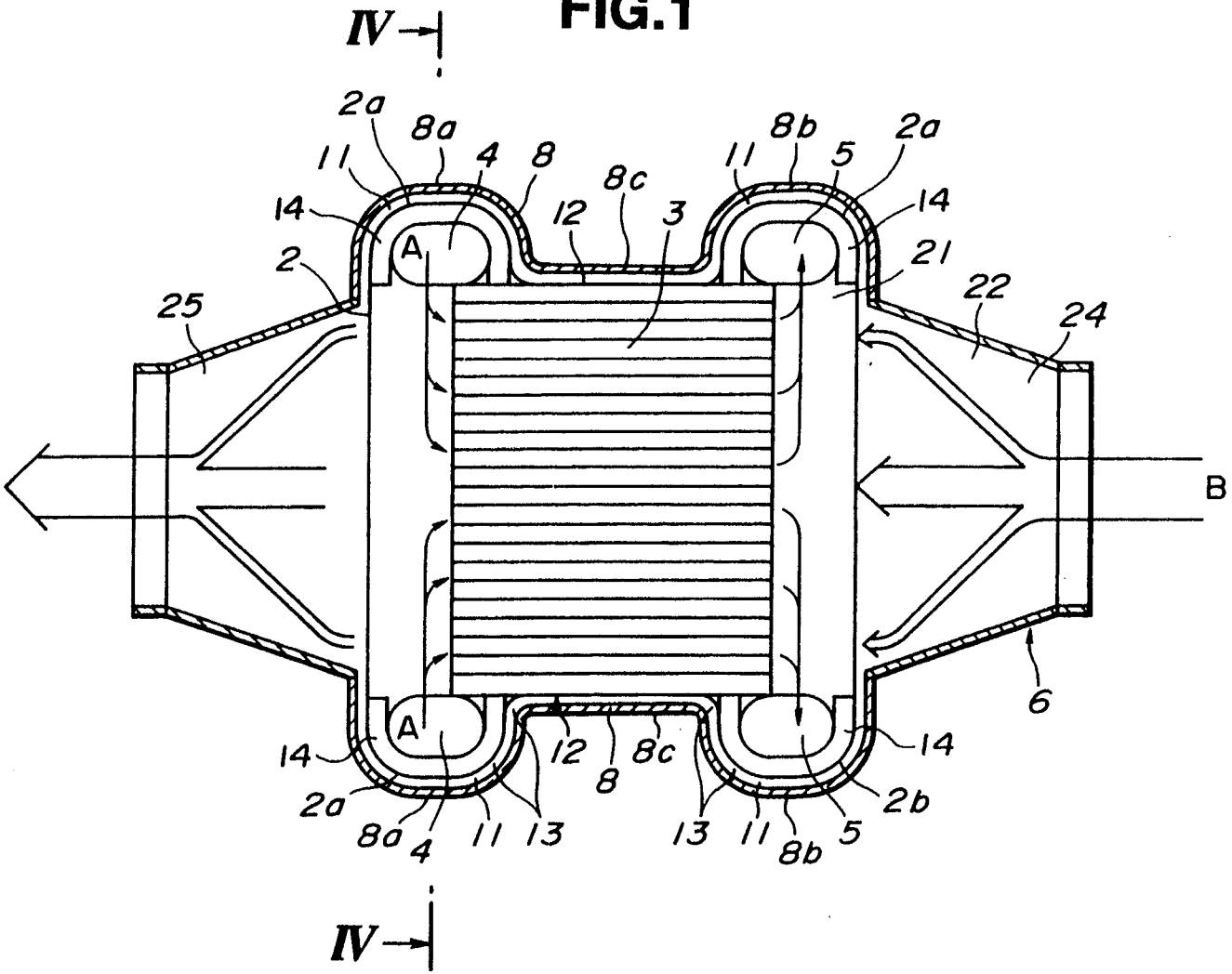
FIG. 1 is a horizontal cross-sectional view of a first embodiment of a heat exchanger according to the present invention.

Referring to FIGS. 1 to 6, there is shown a first embodiment of a heat exchanger H according to the present invention.

As shown in FIGS. 1 to 4, the heat exchanger H comprises a plurality of tube elements 2 which define first-fluid passages 21, respectively, such that a low-temperature fluid A flows the first fluid passage 21. A plurality of inner fins 3 are disposed in the tube elements 2, respectively. Each of the tube elements 2 has two inlet ports 4 through which the low-temperature fluid A flows into the tube elements 2 and two outlet ports 5 through which the low-temperature fluid A flows out the tube elements 2. All of the inlet ports 4 and the outlet ports 5 are disposed so as to outwardly protrude from both lateral side portions 1*a* of each outer fin 1.

Figure 2:
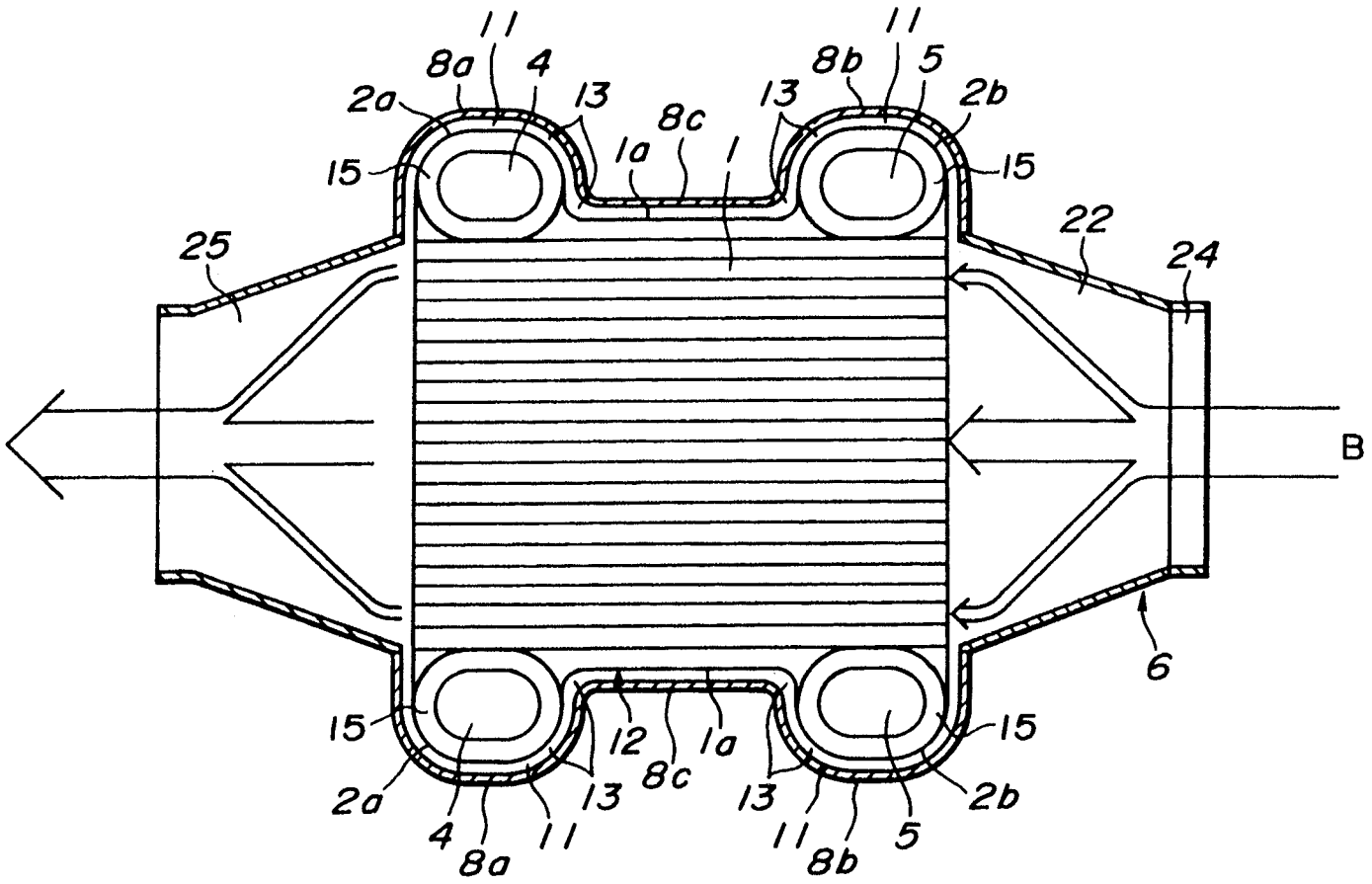
FIG. 2 is another horizontal cross-sectional view of the heat exchanger of FIG. 1.

As shown in FIG. 2, the heat exchanger H has a housing 6 by which a second-fluid passage 22 for a high-temperature fluid B is defined. The tube elements 2 are alternately laminated with a plurality of outer fins 1 and disposed in the housing 6. An inlet duct 24 for the high-temperature fluid B is formed at one end of the housing 6, and an outlet duct 24 is formed at the other end of the housing 6.

Figure 3:
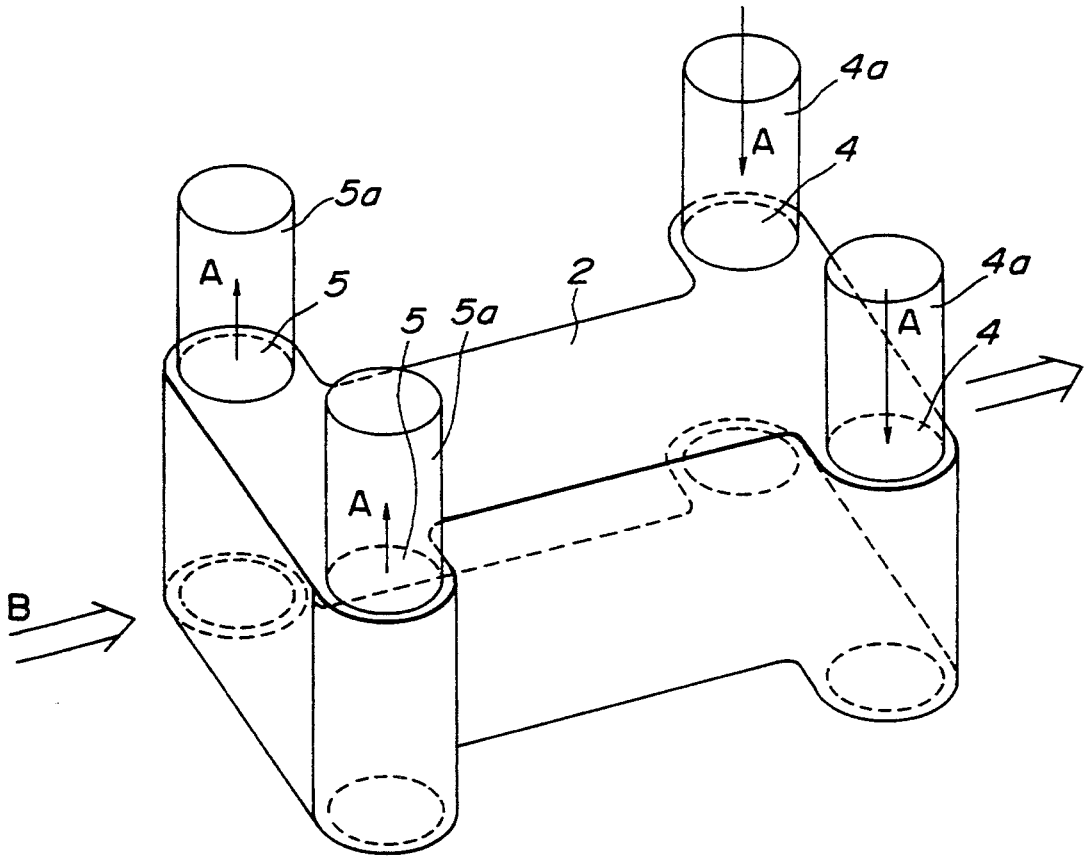
FIG. 3 is a schematic perspective view which shows the heat exchanger of FIG. 1.

The heat exchanger H is arranged such that the low-temperature fluid A flows into the tube elements 2 from an upper portion of the inlet ports 4 and is distributed to the first passages 21 through the inlet ports 4, as shown by arrows in FIG. 3. Then, the low-temperature fluid A flows out through the outlet ports 5 to an upper side of the heat exchanger H. When the low-temperature fluid A and the high-temperature fluid B flow through the first-fluid passages 21 and the second-fluid passage 22, respectively, the heat transfer therebetween is implemented by the heat exchanger H.

A pair of inlet ducts **4*a* are connected to the housing 6 to supply the low-temperature fluid A to the inlet ports 4. Similarly, a pair of outlet ducts 5*a* are connected to the housing 6 to discharge the low-temperature fluid A from the outlet ports 5**.

Figures 4, 4C, 4D:
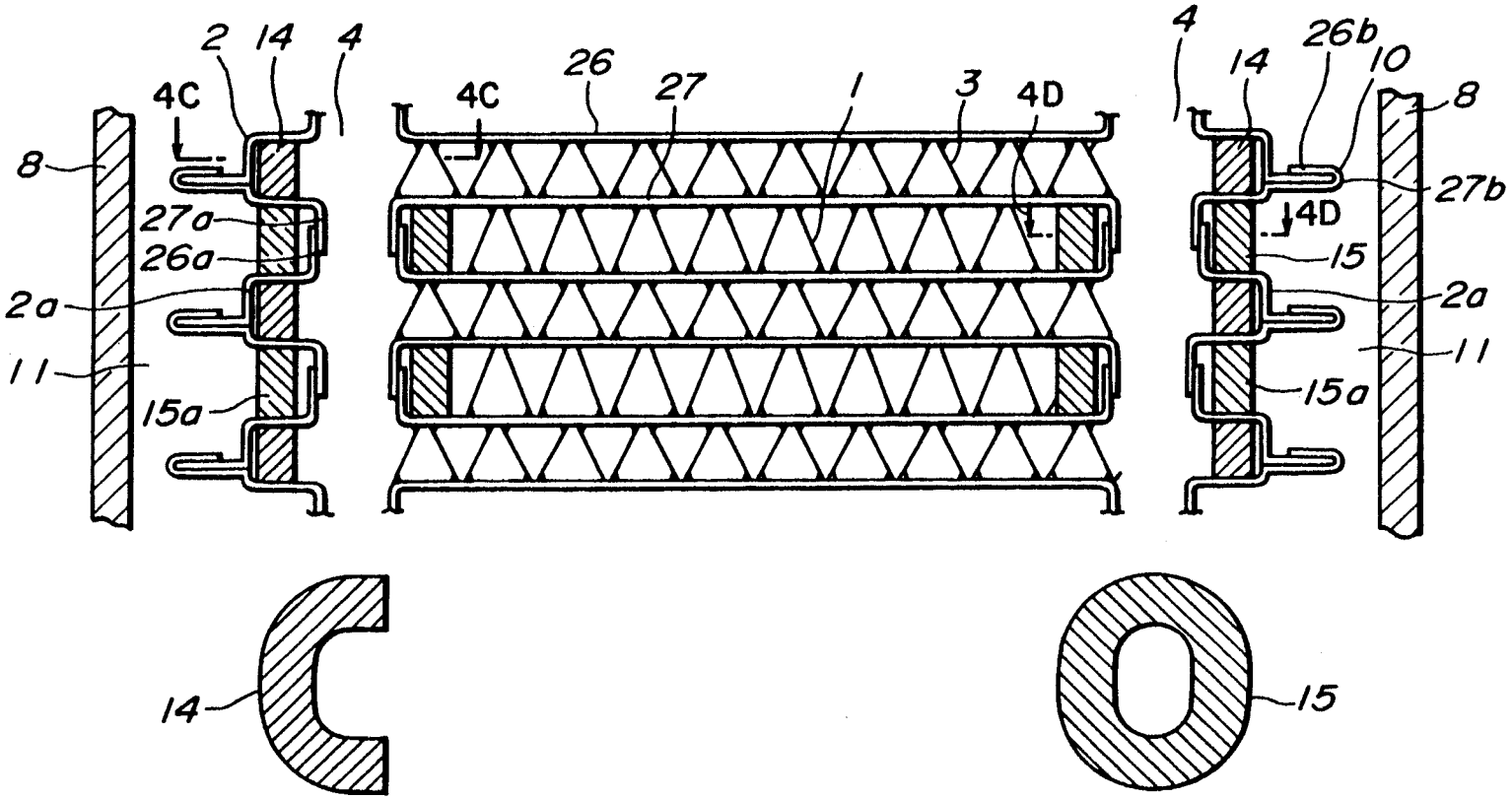
FIG. 4 is a cross-sectional view of the heat exchanger taken in the direction of arrows substantially along the line IV—IV of FIG. 1.

As shown in FIG. 4, each of the tube elements 2 is constituted by an upper plate 26 and a lower plate 27 which are assembled with each other while sandwiching an inner fin 3 therebetween. A peripheral portion **27*b* of the lower plate 27 is bent so as to surround a peripheral portion 26*b* of the upper plate 26, and the peripheral portions 26*b* and 27*b* are then connected in a self-locking joint. Four flanged through-holes 26*a* are formed at portions corresponding to the inlet and outlet ports of each upper plate 26. Similarly, four flanged through-holes 27*a* are formed at portions corresponding to the inlet and outlet ports 4 and 5 of each lower plate 27. The flanged through-holes 26*a* of the upper plate 26 are engaged with the flanged through-holes 27*a* of the lower plate 27, respectively, and therefore the tube elements 2 are precisely fixed and positioned. Four U-shaped spacers 14 are inserted into each of the tube elements 2 so as to surround the inlet and outlet ports 4 and 5, respectively, as shown in FIGS. 1 and 4. Four ring-shaped spacers 15 are disposed so as to surround the engaged flanged through-holes 26*a* and 27*b*, respectively, as shown in FIGS. 2 and 4**.

Figure 5:
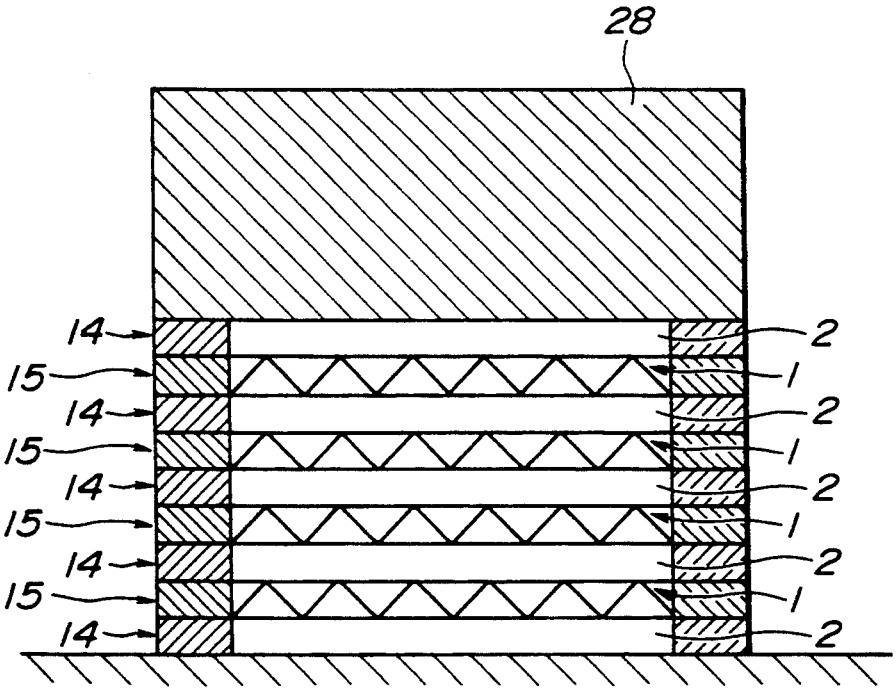
FIG. 5 is a schematic cross-sectional view for explaining a solidity of the heat exchanger of FIG. 4.

Each of the spacers 15 is fixed to the upper and lower plates 26 and 27 by brazing. This brazing ensures the sealing performance at the inlet and outlet ports 4 and 5. In addition, the upper and lower plates 26 and 27, inner and outer fins 3 and 1, and spacers 14 and 15 are fixed to contacting surfaces therewith by brazing. Furthermore, the spacers 14 and 15 prevent the generation of dimensional variation between the upper and lower plates 26 and 27 and ensure resistance to loads and impacts. Accordingly, even if a weight 28 is put on the heat exchanger H as shown in FIG. 5, the heat exchanger H is durable without degrading the performance of the heat exchanger H. Since the spacers 14 and 15 improve the strength of the heat exchanger H, it is possible to reduce the requirement of the strength in the inner and outer fins 3 and 1. This enables the reduction of the thickness of the inner and outer fins 3 and 1, and therefore the pressure drop of the heat exchanger H is reduced.

A pair of side plates 8 constituting side portions of the housing 6 are shaped along peripheral walls **2*a* and 2*b* of the tube elements 2 so as to form projections 8*a*, 8*b* and depressions 8*c* while keeping a predetermined space 11 between the tube elements 2 and the housing 6**.

The inner fins 3 and the outer fins 1 are corrugated and disposed such that the corrugated directions of fins 3 and 1 are the same. The inlet ports 4 are located in the vicinity of the outlet duct 25 of the second passage 22, and the outlet ports 5 are located in the vicinity of the inlet duct 24 of the second passage 22. That is, the flowing direction of the low-temperature fluid A directed by the inner fins 3 is opposite to the flowing direction of the high-temperature fluid B directed by the outer fins 1. Accordingly, the heat exchanger H functions as a counter-flow type heat exchanger.

Figure 6:
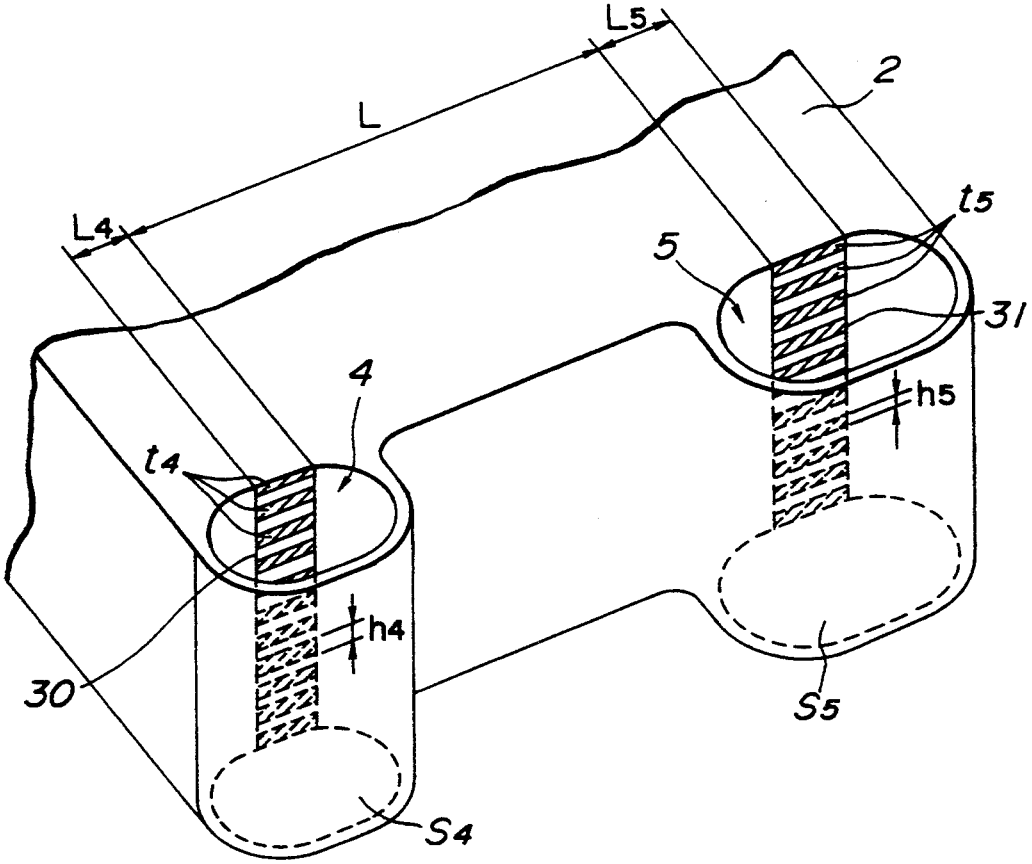
FIG. 6 is a perspective view which shows inlet and outlet ports of laminated tube elements of the heat exchanger of FIG. 1.

As shown in FIG. 6, the relationship among a cross-sectional area $S_4$ of the inlet ports 4, a cross-sectional area $t_4$ of an inlet 30 to the tube elements 2 and the number N of the tube elements 2 laminated in the heat exchanger H are determined to satisfy the following equation (1):

$$S_4 = t_4 \times N \tag{1}$$

Similarly, the relationship among a cross-sectional area $S_5$ of the outlet ports 5, a cross-sectional area $t_5$ of an outlet 31 to the tube elements 2 and the number N of the tube elements 2 laminated in the heat exchanger H are determined so as to satisfy the following equation (2):

$$S_5 = t_5 \times N \tag{2}$$

Furthermore, when an inlet temperature of the low-temperature fluid A is $T_4$, an inlet flow velocity of the low-temperature fluid A is $V_4$, an outlet temperature of the low-temperature fluid A is $T_5$ and an outlet flow velocity of the low-temperature fluid A is $V_5$, these values are determined so as to satisfy the following equation (3):

$$S_4 : S_5 = V_4 : V_5 = \sqrt{T_4} : \sqrt{T_5} \tag{3}$$

The manner of operation of the heat exchanger H according to the present invention will be discussed hereinafter.

As indicated by the arrows of FIG. 1, the low-temperature fluid A flows into the tube elements 2 through the inlet ports 4, then flows along the inner fins 3, and flows out from the outlet ports 5. On the other hand, as shown in FIG. 2, the high-temperature fluid B flows into the housing 6 through the inlet duct 24, then flows along the outer fins 1, and flows out from the outlet duct 25.

Since the flow direction of the low-temperature fluid A is opposite to the flow direction of the high-temperature fluid B, the thermal distribution in the tube elements 2 is equalized and therefore the heat transmission efficiency is improved as compared with a conventional cross-flow type heat exchanger. This enables the heat exchanger to become smaller.

Since the outer walls **2*a* and 2*b* of the tube elements 2 and the projections 8*a* and 8*b* of the side plates 8 are formed curved, the drag of the passage formed by the housing 5 and the tube elements 2 is increased due to largely curved portions 13. Accordingly, the high-temperature fluid B mainly flows through the outer fins 1 while decreasing the amount of the flow passing through the clearance 11 between the housing 6 and the tube elements 2**. Therefore, the heat transmission coefficient by this heat exchange H is improved.

More particularly, when the high-temperature fluid B flows the curved portion 13 of the clearance 11, its pressure drop is 0.2 to 0.6 times of dynamic pressure.

For example, when the pressure of the high-temperature fluid B is the atmospheric pressure, the temperature is 500° C., the flow rate is 100 g/s and the cross-sectional area of the clearance 11 is one-tenth of the total cross-sectional area of the passage for the fluid B, it is noted that the flow rate passing through the clearance 11 is greater than 10 g/s. Furthermore, when the width of a peripheral fixing portion 10 of the tube element 2 is 3 mm, the distance between the tip portion of the peripheral fixing section 20 and the side plate 8 is 1 mm, and the distance between upper and lower inner walls of the housing 6 is 100 mm, the cross-sectional area of the clearance 11 is smaller than the $400\times2$ mm$^2$. Accordingly the velocity of the high-temperature fluid B becomes larger than the value V expressed by the following equation.

$$V=(100\times0.1)/\{(400\times2\times10^{-6})\times\rho\}\approx27.2\ (\mathrm{m/s})$$

Therefore, the pressure drop at the four largely curved portions 13 of the clearance 11 is larger than 408 (Pa)$=4\times0.46\times(\frac{1}{2})\times27.2^2\times0.6$. Since the atmospheric pressure is $1.01325\times10^5$ (Pa), the pressure drop at the portions 11 is about 4% of the atmospheric pressure (pressure of the fluid B). Therefore, the flow rate which flows into the clearance 11, is reduced about 4% ($1/1.04\approx0.96$ times).

On the other hand, since the cross-sectional area $S_4$ of the inlet ports 4 is determined to satisfy the equation (1) and the cross-sectional area $S_5$ of the outlet ports 5 is determined to satisfy the equation (2), the variation of the velocity of the low-temperature fluid A is suppressed and therefore decreases the pressure drop at the inlet and outlet ports 4 and 5.

Furthermore, since the cross-sectional area $S_4$ and the cross-sectional area $S_5$ are determined to satisfy the relationship represented by the equation (3), the variation of the momentum of the fluid B at the inlet and outlet ports 4 and 5 is suppressed to reduce the pressure drop.

Figure 7:
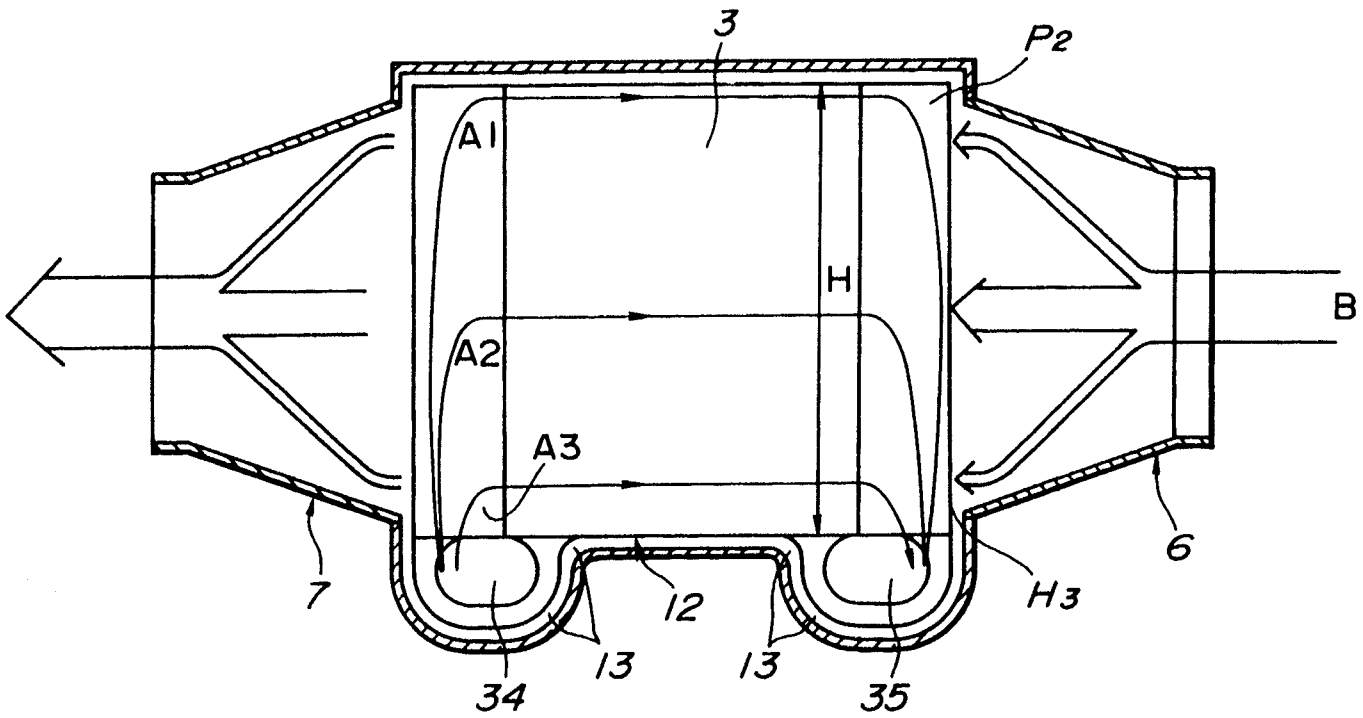
FIG. 7 is a horizontal cross-sectional view of a second embodiment of the heat exchanger according to the present invention.

Referring to FIG. 7, there is shown a second embodiment of the heat exchanger H according to the present invention. In this embodiment, corresponding parts to that of the first embodiment are designed by corresponding reference numerals of the first embodiment.

In the second embodiment, the heat exchanger H is provided with the one inlet port 34 and the one outlet port 35 for the low-temperature fluid A. When a cross-sectional area of the inlet port 34 is $S_{34}$, the cross-sectional area of each inlet of each tube element 2 is $t_{34}$ and the number of the tube elements 2 is N, the cross-sectional areas $S_{34}$ and $t_{34}$ and the number N are determined to satisfy the following equation (4):

$$S_{34}=t_{34}\times N \tag{4}$$

Similarly, when a cross-sectional area of the outlet port 35 is $S_{35}$, the cross-sectional area of each outlet of each tube element 2 is $t_{35}$ and the number of the tube elements 2 is N, the cross-sectional areas $S_{35}$ and $t_{35}$ and the number N are determined to satisfy the following equation (5):

$$S_{35}=t_{35}N \tag{5}$$

Furthermore, when an inlet temperature of the low-temperature fluid A is $T_4$, an inlet flow velocity of the low-temperature fluid A is $V_4$, an outlet temperature of the low-temperature fluid A is $T_5$ and an outlet flow velocity of the low-temperature fluid A is $V_5$, these values are determined so as to satisfy the following equation (6):

$$S_{34}:S_{35}=V_4:V_5=\sqrt{T_4}:\sqrt{T_5} \tag{6}$$

Figure 8:
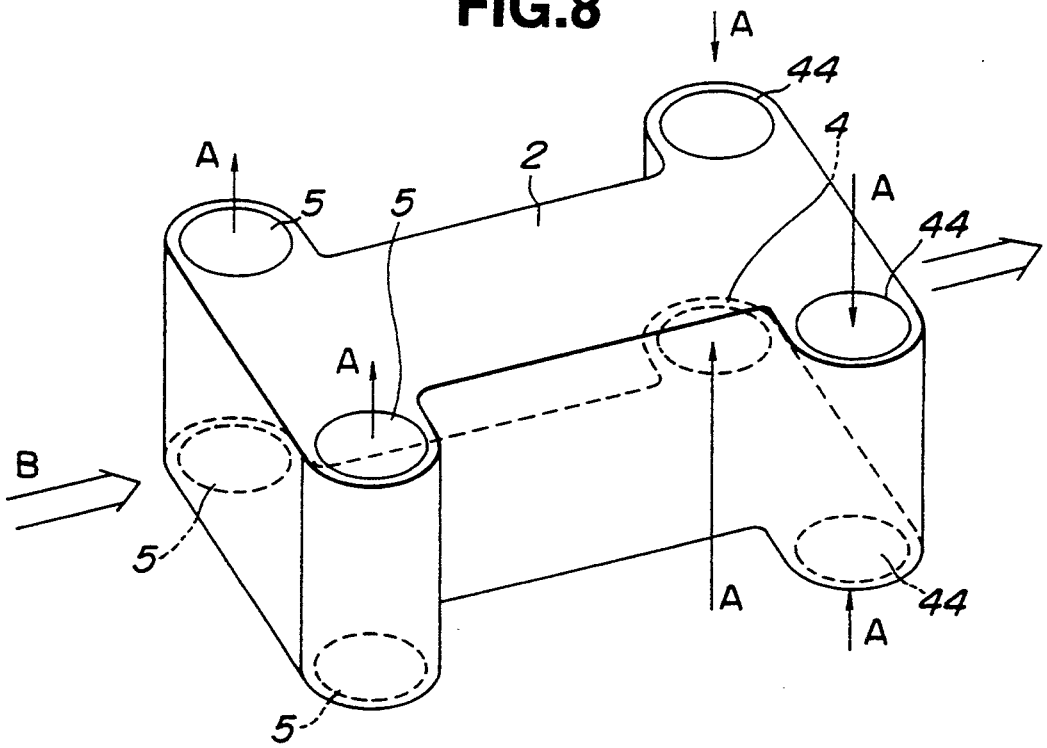
FIG. 8 is a schematic perspective view of a third embodiment of the heat exchanger according to the present invention.

Referring to FIG. 8, there is shown a third embodiment of the heat exchanger H according to the present invention.

The construction of the third embodiment is generally similar to that of the first embodiment except that the low-temperature fluid A is flowed into the tube elements 2 through four inlet ports 44 which are formed at upper two portions and lower two portions as shown in FIG. 8.

With this arrangement, when the cross-sectional area $S_{44}$ of each inlet port 44 is equal to the cross-sectional area $S_4$ of each inlet port 4 of the first embodiment, the velocity of low-temperature fluid A in the inlet ports 44 is one-half of that of the first embodiment. Accordingly, the pressure drop at the inlet ports 44 becomes one-fourth of that at the inlet ports 4 of the first embodiment. In other words, by determining that the velocity of the inlet ports 44 of the third embodiment is the same as that of the inlet ports 4 of the first embodiment, it is possible to reduce the cross-sectional area $S_{44}$ so as to be one-half of that of the first embodiment. This enables the heat exchanger H to be made smaller.

Figure 9:
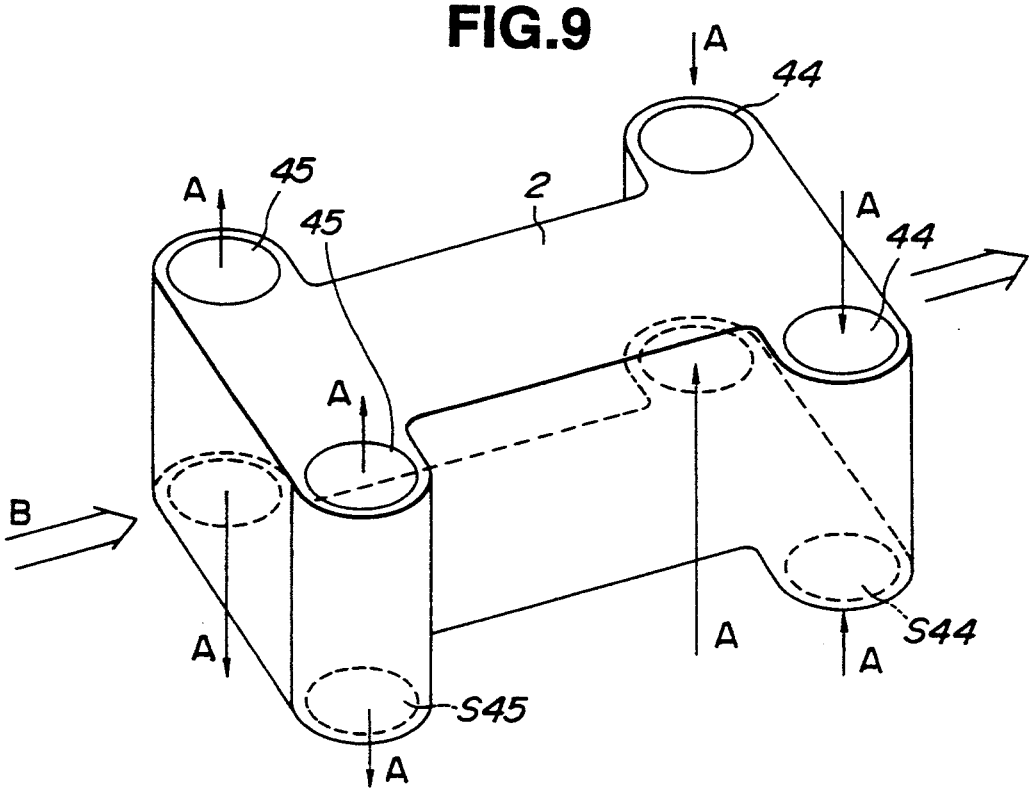
FIG. 9 is a schematic perspective view of a fourth embodiment of the heat exchanger according to the present invention.

Referring to FIG. 9, there is shown a fourth embodiment of the heat exchanger H according to the present invention.

The construction of the fourth embodiment is generally similar to that of the first embodiment except that the low-temperature fluid A is flowed into the tube elements 2 through four inlet ports 44 which are formed at upper two portions and lower two portions, and flowed out through four outlet ports 45 which are formed at upper two portions and the lower two portion.

With this arrangement, in addition to the reduction of the pressure drop at the inlet ports 44, the pressure drop at the outlet ports 45 is reduced as is similar to the reduction at the inlet ports 44 which is mention in the third embodiment. Therefore, it becomes possible to further form the heat exchanger small in size. Furthermore, when an inlet temperature of the low-temperature fluid A is $T_4$, an inlet flow velocity of the low-temperature fluid A is $V_4$, an outlet temperature of the low-temperature fluid A is $T_5$ and an outlet flow velocity of the low-temperature fluid A is $V_5$, these values are determined so as to satisfy the following equation (7):

$$S_{44}:S_{45}=V_4:V_5=\sqrt{T_4}:\sqrt{T_5} \tag{7}$$

Figure 10:
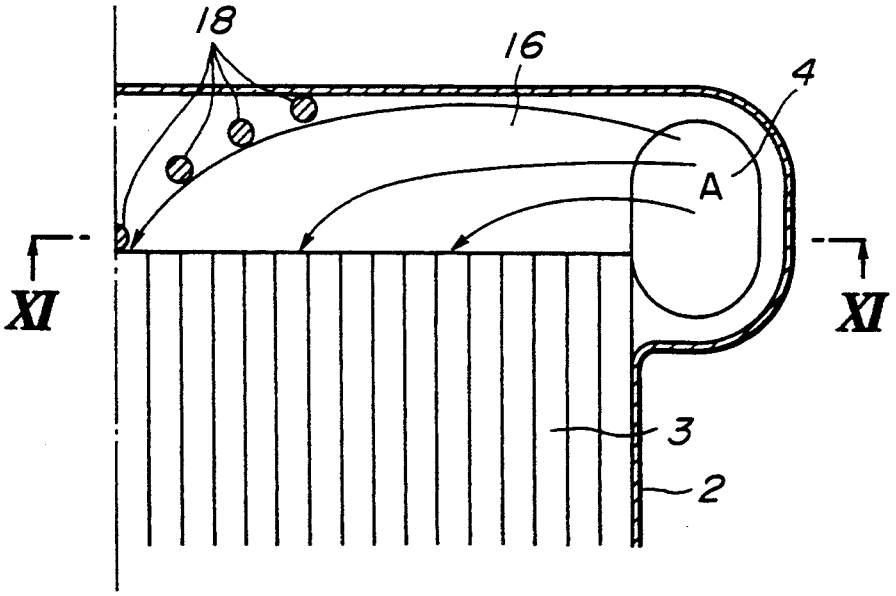
FIG. 10 is a partial cross-sectional view of a fifth embodiment of the heat exchanger according to the present invention.
Figure 11:
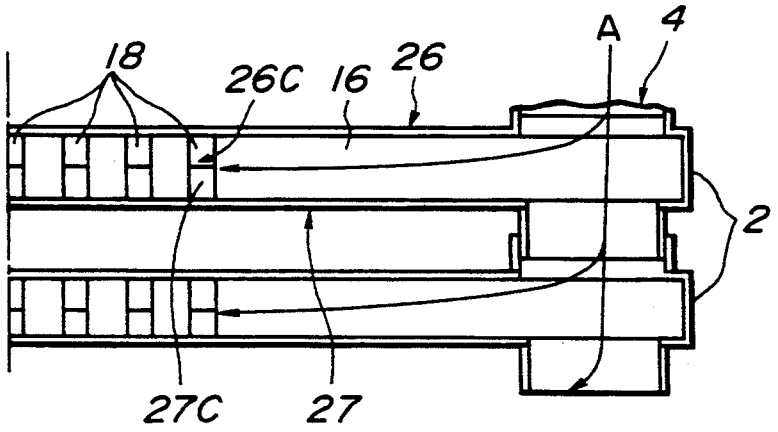
FIG. 11 is a cross-sectional view of FIG. 10 taken in the direction of arrow substantially along the line XI—XI.

Referring to FIGS. 10 and 11, there is shown a fifth embodiment of the heat exchanger H according to the present invention.

The construction of the fifth embodiment is generally similar to that of the first embodiment. In the fifth embodiment, a plurality of columns 18 are disposed at a space 16 which communicates the inlet port 4 and the inner fin 3 in the tube element 2. The columns 18 are arranged along with a stream line of the low-temperature fluid A as shown in FIG. 10 so as to smoothly flow the low-temperature fluid A to the inner fin 3 without causing the stagnation in the space 16. The upper and lower plates 26 and 27 are provided with projections 26c and 27c formed by press working, respectively. The projections 26c and 27c are integrally connected by brazing and constitute the columns 18. Accordingly, the columns 18 function to improve the rigidity of the tube elements 3, more particularly the rigidity at parts of the upper and lower plates 26 and 27 corresponding to the space 6. Furthermore, the columns 18 function to suppress the deformation of the tube elements 2 during brazing.

Since the columns 18 are arranged along the stream line of the low-temperature fluid A, the pressure drop at the space 16 is reduced. When the density of the low-temperature fluid A is $\rho$, an average velocity in the vicinity of the inlet port 4 in the inlet space 16, the kinetic pressure is $\frac{1}{2}\rho v^2$ and the pressure drop coefficient is $\xi$, the pressure drop at the inlet space 16 is represented by $\xi\rho v^2/2$. Since the columns 18 function as a guide member of the low-temperature fluid A, the pressure drop coefficient in this embodiment decreases by 1 at most.

Figure 12:
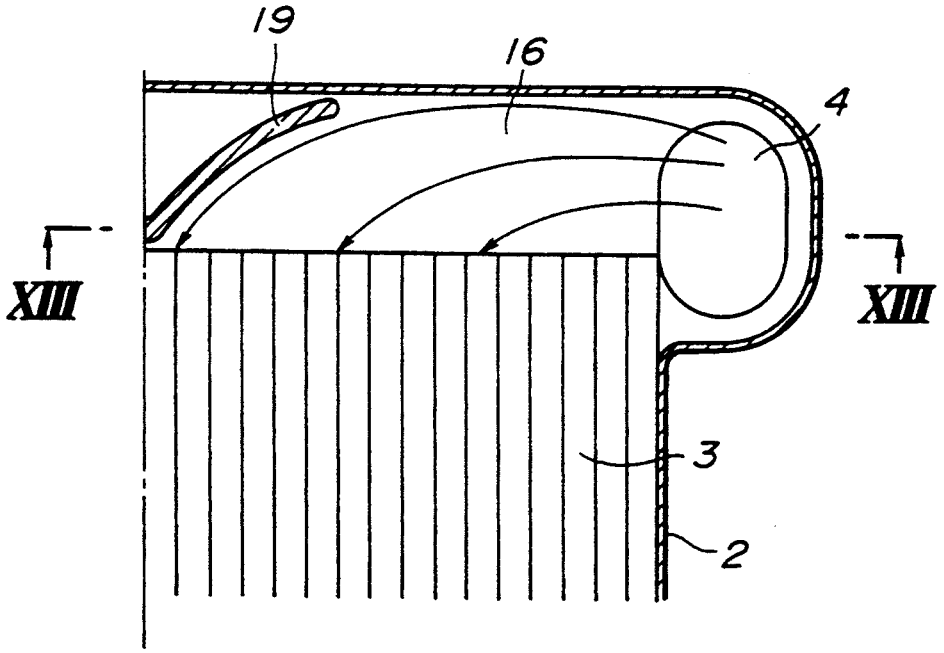
FIG. 12 is a partial cross-sectional view of a sixth embodiment of the heat exchanger according to the present invention.
Figure 13:
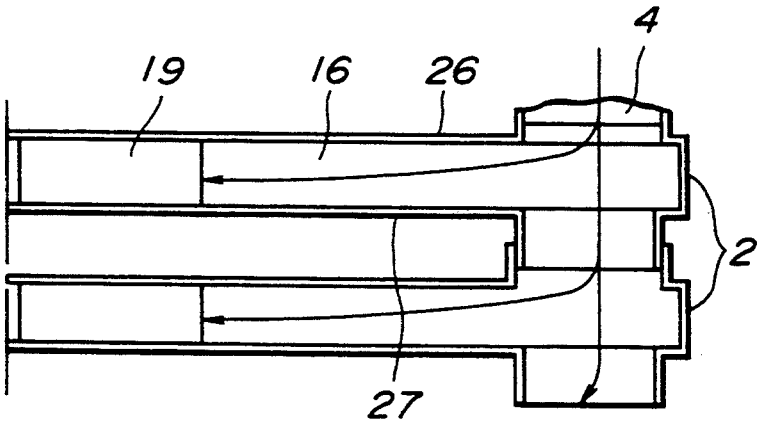
FIG. 13 is a cross-sectional view of FIG. 12 taken in the direction of arrow substantially along the line XIII—XIII.

Referring to FIGS. 12 and 13, there is shown a sixth embodiment of the heat exchanger H according to the present invention.

The construction of the sixth embodiment is generally similar to that of the first embodiment. In the sixth embodiment, a winglike guide member 19 is disposed at the space 16 which communicates the inlet port 4 and the inner fin 3 in the tube element 2. The guide member 18 is arranged such that a stream line of the low-temperature fluid A smoothly flows through the space 16 toward the inner fin 3 without causing the stagnation in the space 16. The guide member 19 also functions to improve the rigidity of the tube elements 2. Furthermore, the guide member 19 functions to suppress the deformation of the tube elements 2 during brazing.

Figure 14:
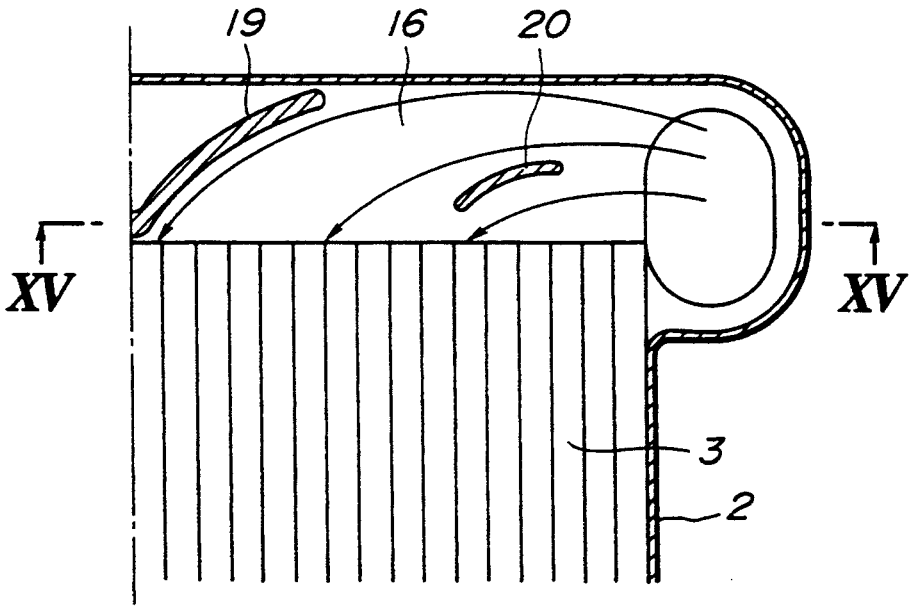
FIG. 14 is a partial cross-sectional view of a seventh embodiment of the heat exchanger according to the present invention.
Figure 15:
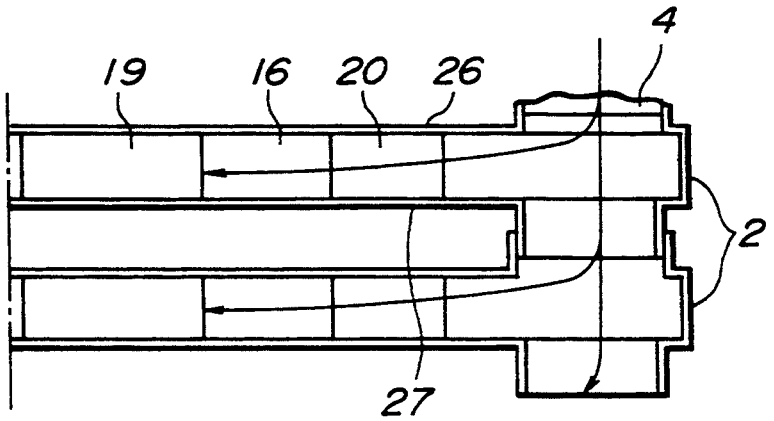
FIG. 15 is a cross-sectional view of FIG. 14 taken in the direction of arrow substantially along the line XV—XV.
Figure 16:
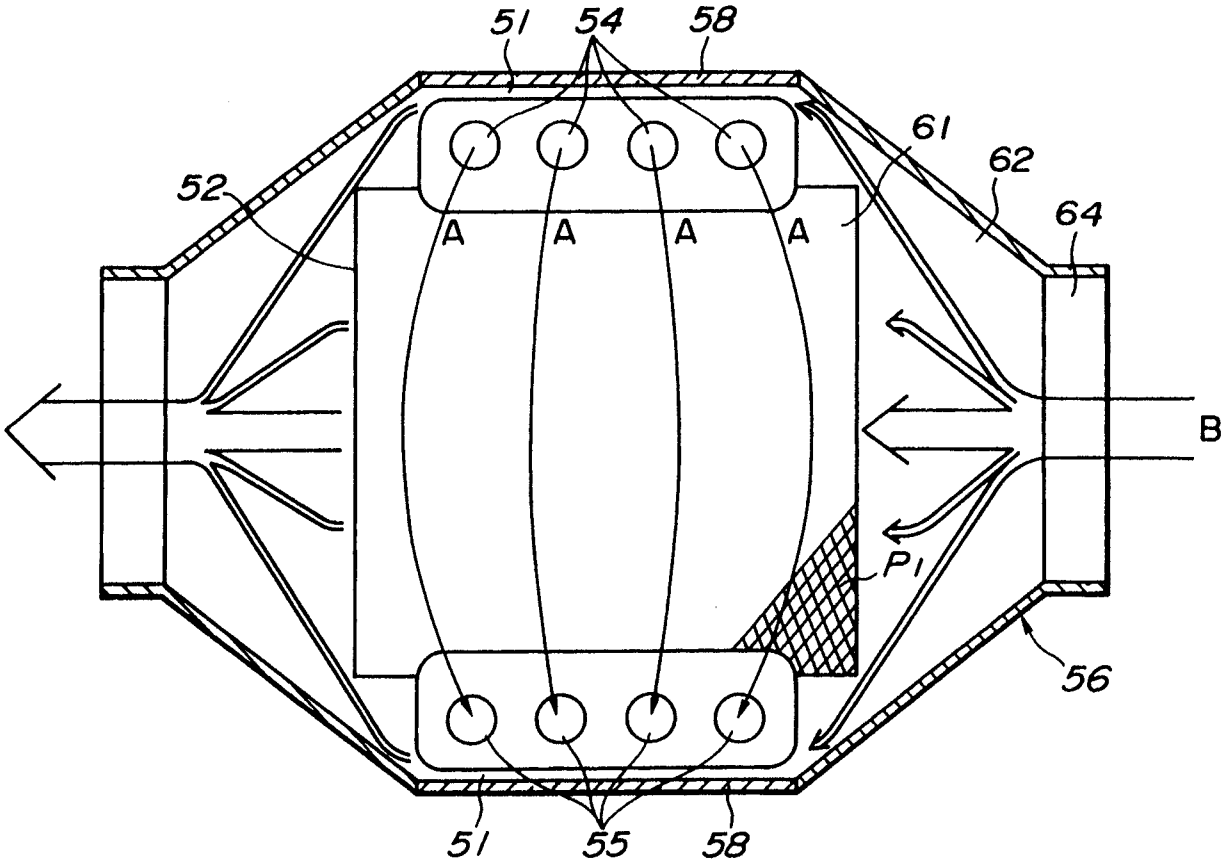
FIG.16 (PRIOR ART)
FIG. 16 is a horizontal cross-sectional view of a conventional heat exchanger.

Referring to FIGS. 14 and 15, there is shown a seventh embodiment of the heat exchanger H according to the present invention.

The construction of the seventh embodiment is generally similar to that of the sixth embodiment. In the seventh embodiment, a sub guide member 20 in addition to a winglike guide member 19 is disposed at the space 16 which communicates the inlet port 4 and the inner fin 3 in the tube element 2 as shown in FIG. 14. The sub guide member 20 is arranged with the winglike guide member 19 such that a stream line of the low-temperature fluid A further smoothly flows through the space 16 toward the inner fin 3 without causing the stagnation in the space 16. The winglike and sub guide members 19 and 20 also function to improve the rigidity of the tube elements 2.

Although the preferred embodiments have been shown and described such that the guide members are disposed in the space 18 between the inlet port and inner fin 3, it will be understood that such guide members may be installed in a space between the inner fin 3 and the outlet port 5 in the tube element 2.

While the first embodiment has been shown and described such that the spacers 14 and 15 are disposed in the tube elements and at surrounding portions of the flanged portions, it will be understood that the heat exchanger may be formed without the use of the spacers 14 and 15.

It is further understood by those skilled in the art that the foregoing description is preferred embodiments of the disclosed heat exchanger and that various changes and modifications may be made in the invention without departing from the sprit and scope thereof.

What is claimed is:

1. A heat exchanger for first and second fluids, comprising:

a plurality of tube elements defining first fluid flowing spaces, respectively;

a plurality of inner fins disposed in the first-fluid flowing spaces of said tube elements, respectively;

a first-fluid inlet port connected to said tube elements so as to guide the first fluid into the first-fluid flowing space, said first-fluid inlet port being located so as to outwardly project from a lateral side of said inner fins;

a first-fluid outlet port connected to said tube elements so as to discharge the first fluid from the first-fluid flowing space, said first-fluid inlet port being located to outwardly project from the lateral side of said inner fin;

a plurality of outer fins alternately laminated with said tube elements;

a housing surrounding said tube elements and defining a second-fluid flowing space therebetween, said housing having a second-fluid inlet port and a second-fluid outlet port, said housing being formed so as to be curved along a peripheral wall of said tube element which defines said first-fluid inlet and outlet ports.

2. A heat exchanger as claimed in claim 1, wherein said first-fluid inlet port includes-two inlet ports which are disposed opposite to each other relative to said outer fin.

3. A heat exchanger as claimed in claim 1, wherein said first-fluid outlet port includes two outlet ports which are disposed opposite to each other relative to said outer fin.

4. A heat exchanger as claimed in claim 1, wherein said tube element is provided with an inlet space between said inlet port and said inner fin and an outlet space between said inner fin and said outlet port.

5. A heat exchanger as claimed in claim 4, wherein a fluid guide member is disposed in at least one of the inlet space and the outlet space.

6. A heat exchanger as claimed in claim 5, wherein said fluid guide member includes a plurality of columns in case that the heat exchanger has two inlet or two outlet ports, said columns being disposed in the space of two ports and being located generally at a center of width relative to the first-fluid flowing direction.

7. A heat exchanger as claimed in claim 5, wherein said fluid guide member includes a plurality of columns in case that the heat exchanger has two inlet or two outlet ports, said columns being disposed in the space of two ports and being located generally at a center of width relative to the first-fluid flowing direction.

8. A heat exchanger as claimed in claim 1, wherein the relationship among a cross-sectional area $S_4$ of the first-fluid inlet port, a cross-sectional area 14 of inlet of each tube element and the number N of said tube elements is determined so as to satisfy the following equation:

$$S_4 = t_4 \times N$$

9. A heat exchanger as claimed in claim 1, wherein the relationship among a cross-sectional area $S_5$ of the first-fluid outlet port, a cross-sectional area $t_5$ of outlet of each tube element and the number N of said tube elements is determined so as to satisfy the following equation:

$$S_5 = t_5 \times N$$

10. A heat exchanger as claimed in claim 1, wherein cross-sectional areas $S_4$, $S_5$ of the first-fluid inlet and outlet ports, inlet and outlet velocities $V_4$, $V_5$ of the first fluid in said tube element, and inlet and outlet temperatures $T_4$, $T_5$ to said tube element are determined so as to satisfy the following relationship:

$$S_4 : S_5 = V_4 : V_5 = \sqrt{T_4} : \sqrt{T_5}$$

11. A heat exchanger as claimed in claim 1, wherein the first-fluid flowing space is a generally rectangular shape.

12. A heat exchanger as claimed in claim 1, wherein said inner and outer fins are formed in a rectangle.

* * * * *